US009494304B2

(12) United States Patent
Dixon

(10) Patent No.: US 9,494,304 B2
(45) Date of Patent: Nov. 15, 2016

(54) RECESSED LIGHT FIXTURE RETROFIT KIT

(71) Applicant: CREE, INC., Durham, NC (US)

(72) Inventor: Mark E. Dixon, Morrisville, NC (US)

(73) Assignee: CREE, INC., Durham, NC (US)

( * ) Notice: Subject to any disclaimer, the term of this patent is extended or adjusted under 35 U.S.C. 154(b) by 255 days.

(21) Appl. No.: 13/672,592

(22) Filed: Nov. 8, 2012

(65) Prior Publication Data

US 2014/0126195 A1 May 8, 2014

(51) Int. Cl.

| | |
|---|---|
| ***F21V 21/00*** | (2006.01) |
| ***F21S 8/02*** | (2006.01) |
| *F21Y 101/02* | (2006.01) |
| *F21Y 103/00* | (2016.01) |

(52) U.S. Cl.

CPC ..... *F21V 21/00* (2013.01); *F21S 8/026* (2013.01); *F21Y 2101/02* (2013.01); *F21Y 2103/003* (2013.01); *Y10T 29/49002* (2015.01); *Y10T 29/49117* (2015.01); *Y10T 29/49128* (2015.01)

(58) Field of Classification Search

CPC .... F21S 8/026; F21V 21/00; F21Y 2101/02; F21Y 2103/003; Y10T 29/002; Y10T 29/49117; Y10T 29/49128

USPC ..... 362/217.01, 217.12, 217.16, 218, 221, 362/223, 224, 225, 249.02, 260, 398

See application file for complete search history.

(56) References Cited

U.S. PATENT DOCUMENTS

| | | | | |
|---|---|---|---|---|
| D85,382 | S | 10/1931 | Guth | D26/24 |
| 4,118,763 | A | 10/1978 | Osteen | 359/833 |
| 4,300,185 | A | 11/1981 | Wakamatsu | 362/147 |
| 4,464,707 | A | 8/1984 | Forrest | 362/271.06 |
| 4,472,767 | A | 9/1984 | Wenman | 362/147 |
| 4,946,547 | A | 8/1990 | Palmour et al. | |
| 5,200,022 | A | 4/1993 | Kong et al. | |
| RE34,861 | E | 2/1995 | Davis et al. | |

(Continued)

FOREIGN PATENT DOCUMENTS

| | | |
|---|---|---|
| CN | 101188261 | 5/2008 |
| CN | 202580962 | 12/2012 |

(Continued)

OTHER PUBLICATIONS

International Search Report and Written Opinion from PCT/US2013/049225, dated Oct. 24, 2013.

(Continued)

*Primary Examiner* — Stephen F Husar

(74) *Attorney, Agent, or Firm* — Koppel, Patrick, Heybl & Philpott

(57) ABSTRACT

This disclosure relates to retrofit systems and methods for lighting installations, and in particular, to retrofit systems and methods used to retrofit troffer-style lighting installations with LED light sources. Retrofit systems can be used with different light fixtures, but those described are particularly adapted for use with troffer-style fixtures. These retrofit systems can provide the same amount of light as traditional light fixtures already do, for example 1600-4000 lumens or more. The retrofit systems can be used with many different light sources but are particularly well-suited for use with solid state light sources or light engines, such as those utilizing LEDs. Some embodiments of the present invention comprise a mechanical mounting system for installing an LED light engine within an existing lighting system housing or pan, such as a troffer pan, without penetrating the ceiling plenum.

68 Claims, 4 Drawing Sheets

(56) References Cited

U.S. PATENT DOCUMENTS 5,530,628 A 6/1996 Ngai ..... 362/127
5,690,415 A 11/1997 Krehl ..... 362/125
5,823,663 A 10/1998 Bell et al. ..... 362/362
D407,473 S 3/1999 Wimbock ..... D23/328
5,951,150 A 9/1999 Helstern ..... 362/293
6,155,699 A 12/2000 Miller et al. ..... 362/293
6,210,025 B1 4/2001 Schmidt et al. ..... 362/362
6,435,697 B1 8/2002 Simmons ..... 362/219
6,443,598 B1 9/2002 Morgan ..... 362/342
6,523,974 B2 2/2003 Engel ..... 362/224
6,536,924 B2 3/2003 Segretto ..... 362/247
6,667,451 B1 12/2003 Hart ..... 200/314
6,739,734 B1 5/2004 Hulgan ..... 362/243
D496,121 S 9/2004 Santoro ..... D26/74
6,914,194 B2 7/2005 Fan
6,948,840 B2 9/2005 Grenda et al. ..... 362/555
7,021,797 B2 4/2006 Minano et al. ..... 362/355
7,049,761 B2 5/2006 Timmermans et al. ..... 315/246
7,131,747 B1 11/2006 Yates ..... 362/219
7,213,940 B1 5/2007 Van de Ven et al. ..... 362/231
7,217,023 B2 5/2007 Iwasa et al. ..... 362/555
7,228,253 B2 6/2007 Chen ..... 318/11
7,237,924 B2 7/2007 Martineau et al. ..... 362/231
D556,358 S 11/2007 Santoro ..... D26/74
7,387,410 B2 6/2008 Sibout ..... 362/375
7,510,299 B2 3/2009 Timmermans et al. ..... 362/225
D593,246 S 5/2009 Fowler et al. ..... D26/76
7,540,627 B2 6/2009 Handsaker ..... 362/225
7,594,736 B1 9/2009 Kassay et al. ..... 362/223
D604,446 S 11/2009 Fowler et al. ..... D26/76
7,618,160 B2 11/2009 Chinniah et al. ..... 362/326
7,628,506 B2 12/2009 Verfuerth et al. ..... 362/218
D608,932 S 1/2010 Castelli ..... D26/76
7,654,702 B1 2/2010 Ding et al. ..... 362/294
7,654,703 B2 2/2010 Kan et al. ..... 362/362
7,661,844 B2 2/2010 Sekiguchi et al. ..... 362/249
D611,183 S 3/2010 Duarte ..... D26/76
7,686,484 B2 3/2010 Heiking et al. ..... 362/375
7,712,918 B2 5/2010 Siemiet et al. ..... 362/241
7,722,220 B2 5/2010 Van de Ven ..... 362/294
D617,487 S 6/2010 Fowler et al. ..... D26/76
7,758,207 B1 7/2010 Zhou ..... 362/217.1
7,768,192 B2 8/2010 Van de Ven et al. ..... 313/503
7,791,061 B2 9/2010 Edmond et al.
7,815,338 B2 10/2010 Siemiet et al. ..... 362/218
D633,247 S 2/2011 Kong et al. ..... D26/88
7,988,335 B2 8/2011 Liu et al. ..... 362/294
7,997,762 B2 8/2011 Wang et al. ..... 362/249
8,058,088 B2 11/2011 Cannon et al.
8,070,326 B2 12/2011 Lee ..... 362/307
D653,376 S 1/2012 Kong et al. ..... D26/76
8,092,049 B2 1/2012 Kinnune et al. ..... 362/294
8,201,968 B2 6/2012 Maxik et al.
8,206,004 B2 6/2012 Serak et al. ..... 362/217
8,220,953 B1 7/2012 Moore ..... 362/217.01
8,313,212 B1 11/2012 Mayer et al. ..... 362/219
8,317,369 B2 11/2012 McCanless ..... 362/368
8,342,714 B1 1/2013 Rea ..... 362/264
8,376,578 B2 2/2013 Kong, II ..... 362/241
8,459,824 B1 6/2013 Esmailzadeh et al. ..... 362/147
8,480,252 B2 7/2013 Bertram et al. ..... 362/243
8,506,135 B1 8/2013 Oster ..... 362/373
8,523,383 B1 * 9/2013 Grigore et al. ..... 362/221
8,714,770 B2 5/2014 Kato ..... 362/217.06
8,764,220 B2 7/2014 Chan et al. ..... 362/217.02
9,057,493 B2 6/2015 Simon
2001/0048599 A1 12/2001 Hess ..... 362/290
2004/0001344 A1 1/2004 Hecht ..... 362/555
2004/0240214 A1 12/2004 Whitlow et al. ..... 362/373
2004/0252521 A1 12/2004 Clark ..... 362/554
2005/0041418 A1 2/2005 Fan ..... 362/217.05
2005/0146867 A1 7/2005 Kassay ..... 362/217.05
2005/0264716 A1 12/2005 Kim et al.
2006/0050505 A1 3/2006 McCarthy ..... 362/219
2006/0266955 A1 11/2006 Arvin ..... 250/492.1
2006/0278882 A1 12/2006 Leung ..... 257/98
2007/0109779 A1 5/2007 Sekiguchi et al.
2007/0115670 A1 5/2007 Roberts et al.
2007/0115671 A1 5/2007 Roberts et al.
2007/0158668 A1 7/2007 Tarsa et al.
2007/0211457 A1 9/2007 Mayfield et al. ..... 362/223
2007/0253205 A1 11/2007 Welker ..... 362/373
2008/0049422 A1 2/2008 Trenchard et al.
2008/0128723 A1 6/2008 Pang
2008/0173884 A1 7/2008 Chitnis et al.
2008/0179611 A1 7/2008 Chitnis et al.
2008/0232093 A1 9/2008 Kim
2008/0258130 A1 10/2008 Bergmann et al.
2008/0285267 A1 11/2008 Santoro ..... 362/224
2008/0314944 A1 12/2008 Tsai ..... 224/331
2009/0040782 A1 2/2009 Liu et al. ..... 362/555
2009/0046457 A1 2/2009 Everhart ..... 362/235
2009/0161356 A1 6/2009 Negley et al. ..... 362/231
2009/0184333 A1 7/2009 Wang et al.
2009/0196024 A1 8/2009 Heiking et al. ..... 362/150
2009/0207602 A1 8/2009 Reed et al. ..... 362/225
2009/0212304 A1 8/2009 Wang et al.
2009/0224265 A1 9/2009 Wang et al.
2009/0225543 A1 9/2009 Roberts et al.
2009/0237958 A1 9/2009 Kim
2009/0262543 A1 10/2009 Ho ..... 362/373
2009/0290345 A1 11/2009 Shaner ..... 362/249.01
2009/0290348 A1 * 11/2009 Van Laanen et al. ... 362/249.02
2009/0296381 A1 12/2009 Dubord ..... 362/218
2009/0310354 A1 12/2009 Zampini et al. ..... 362/235
2009/0323334 A1 12/2009 Roberts et al.
2010/0002426 A1 1/2010 Wu ..... 362/223
2010/0097794 A1 4/2010 Teng et al. ..... 362/231
2010/0110679 A1 5/2010 Teng et al.
2010/0110701 A1 5/2010 Liu ..... 362/373
2010/0128485 A1 5/2010 Teng ..... 362/294
2010/0142205 A1 6/2010 Bishop ..... 362/249.02
2010/0155763 A1 6/2010 Donofrio et al.
2010/0171404 A1 7/2010 Liu et al. ..... 313/46
2010/0172133 A1 7/2010 Liu ..... 362/235
2010/0188609 A1 7/2010 Matsuki et al.
2010/0214770 A1 8/2010 Anderson ..... 362/133
2010/0214785 A1 8/2010 Chen ..... 362/267
2010/0220469 A1 9/2010 Ivey et al. ..... 362/218
2010/0254128 A1 10/2010 Pickard et al.
2010/0254145 A1 10/2010 Yamaguchi
2010/0254146 A1 10/2010 McCanless
2010/0259927 A1 10/2010 Chien ..... 362/235
2010/0328945 A1 12/2010 Song et al. ..... 362/240
2011/0006688 A1 1/2011 Shim ..... 315/119
2011/0007514 A1 1/2011 Sloan ..... 362/368
2011/0013400 A1 1/2011 Kanno et al.
2011/0028006 A1 2/2011 Shah et al. ..... 439/39
2011/0032714 A1 2/2011 Chang ..... 362/373
2011/0043132 A1 2/2011 Kim et al. ..... 362/235
2011/0090671 A1 4/2011 Bertram et al. ..... 362/84
2011/0090682 A1 4/2011 Zheng ..... 362/218
2011/0103043 A1 5/2011 Ago ..... 362/147
2011/0141734 A1 6/2011 Li et al. ..... 362/235
2011/0156584 A1 6/2011 Kim
2011/0163683 A1 7/2011 Steele et al. ..... 315/192
2011/0199005 A1 8/2011 Bretschneider et al.
2011/0199769 A1 8/2011 Bretschneider et al.
2011/0211330 A1 9/2011 Wang ..... 362/20
2011/0285314 A1 11/2011 Carney et al. ..... 315/294
2011/0286207 A1 11/2011 Chan et al. ..... 362/217.1
2011/0286208 A1 11/2011 Chen ..... 362/217.1
2011/0310604 A1 12/2011 Shimizu ..... 362/235
2011/0310614 A1 12/2011 Budike, Jr. ..... 362/294
2012/0002408 A1 1/2012 Lichten et al. ..... 362/218
2012/0038289 A1 2/2012 Jee et al.
2012/0051041 A1 3/2012 Edmond et al.
2012/0075857 A1 3/2012 Verbrugh ..... 362/249
2012/0081883 A1 4/2012 Wang ..... 362/101
2012/0098424 A1 4/2012 Arik ..... 315/35
2012/0120666 A1 5/2012 Moeller ..... 362/308
2012/0127714 A1 5/2012 Rehn
2012/0140464 A1 6/2012 Huang et al.
2012/0169234 A1 * 7/2012 Shew ..... 315/88

(56) References Cited

U.S. PATENT DOCUMENTS

| | | | | |
|---|---|---|---|---|
| 2012/0182755 | A1 | 7/2012 | Wildner | 362/555 |
| 2012/0218757 | A1 | 8/2012 | Gill | 362/235 |
| 2012/0235199 | A1 | 9/2012 | Andrews et al. | |
| 2012/0250302 | A1 | 10/2012 | Edwards | 362/223 |
| 2013/0039090 | A1 | 2/2013 | Dau | 362/551 |
| 2013/0050998 | A1 | 2/2013 | Chu et al. | 362/218 |
| 2013/0094225 | A1 | 4/2013 | Leichner | 362/368 |
| 2013/0155670 | A1* | 6/2013 | Handsaker | F21V 13/02 362/223 |
| 2013/0258616 | A1 | 10/2013 | Chao | 361/752 |
| 2013/0271979 | A1* | 10/2013 | Pearson et al. | 362/235 |
| 2013/0279156 | A1 | 10/2013 | Kaule | 362/133 |
| 2013/0279180 | A1 | 10/2013 | Pearson et al. | 362/371 |
| 2013/0329425 | A1 | 12/2013 | Lowes et al. | |
| 2014/0085861 | A1 | 3/2014 | Nicolai | 362/84 |
| 2014/0265809 | A1 | 9/2014 | Hussell | |
| 2015/0016100 | A1 | 1/2015 | Ishii | 362/223 |

FOREIGN PATENT DOCUMENTS

| | | | | |
|---|---|---|---|---|
| DE | WO 2008003289 | | 1/2008 | F21S 4/003 |
| DE | 102007030186 | | 1/2009 | |
| DE | 202010001832 | | 7/2010 | |
| EP | 1298383 | A2 | 4/2003 | |
| EP | 1357335 | A2 | 10/2003 | |
| EP | 1653254 | | 3/2006 | |
| EP | 1737051 | | 12/2006 | |
| EP | 1847762 | A2 | 10/2007 | |
| EP | 1860467 | | 11/2007 | |
| JP | 2002344027 | | 11/2002 | |
| JP | U3097327 | | 8/2003 | |
| JP | 2004140327 | | 5/2004 | |
| JP | 2009295577 | | 12/2009 | |
| JP | 2010103687 | | 5/2010 | |
| JP | 2011018571 | | 8/2011 | |
| JP | 2011018572 | | 8/2011 | |
| WO | WO 03102467 | | 12/2003 | |
| WO | WO 2009140761 | A1 | 11/2009 | |
| WO | WO 2009157999 | A1 | 12/2009 | |
| WO | WO 2010042216 | A2 | 4/2010 | |
| WO | WO 2011074424 | A1 | 6/2011 | |
| WO | WO 2011096098 | A1 | 8/2011 | |
| WO | WO 2011098191 | | 8/2011 | |
| WO | WO 2011118991 | A2 | 9/2011 | |
| WO | WO 2011140353 | A2 | 11/2011 | |

OTHER PUBLICATIONS

International Search Report and Written Opinion from PCT Application No. PCT/US2013/021053, dated Apr. 17, 2013.
Final Rejection issued in Korean Design Appl. No. 30-2011-0038114, dated Jun. 14, 2013.
Final Rejection issued in Korean Design Appl. No 30-2011-0038115, dated Jun. 14, 2013.
Final Rejection issued in Korean Design Appl. No, 30-2011-0038116, dated Jun. 17, 2013.
International Search Report and Written Opinion from PCT Patent Appl. No. PCT/US2013/035668, dated Jul. 12, 2013.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
Preliminary Report and Written Opinion from PCT appl. No. PCT/US2012/047084, dated Feb. 6, 2014.
Office Action from U.S. Appl. No. 13/429,080, dated Apr. 18, 2014.
Office Action from U.S. Appl. No. 12/961,385, dated Mar. 11, 2014.
International Search Report and Written Opinion for PCT Application No. PCT/US2011/062396, dated Jul. 13, 2012.
Office Action from Japanese Design Patent Application No. 2011-18570.
Reason for Rejection from Japanese Design Patent Application No. 2011-18571.
Reason for Rejection from Japanese Design Patent Application No. 2011-18572.
International Search Report and Written Opinion for Patent Application No. PCT/US2011/001517, dated: Feb. 27, 2012.
U.S. Appl. No. 12/418,796, filed Apr. 6, 2009.
U.S. Appl. No. 13/429,080, filed Mar. 23, 2012.
U.S. Appl. No. 13/028,946, filed Feb. 16, 2011.
U.S. Appl. No. 13/306,589, filed Nov. 29, 2011.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-E LED's, data sheet, pp. 1-16, copyright 2008-2010.
Cree's XLamp XP-G LED's, data sheet, pp. 1-12, copyright 2009-2011.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
Office Action from U.S. Appl. No. 29/449,316, dated Jun. 5, 2014.
Office Action from U.S. Appl. No. 13/842,150, dated Jun. 18, 2014.
Leviton LED Magnetic Tube Retrofit Series datasheet, 1 page, from www.leviton.com.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl No. 13/370,252, dated Dec. 20, 2013.
Restriction Requirement from U.S. Appl. No. 13/839,130, dated Jul. 28, 2014.
Office Action from U.S. Appl. No. 13/839,130, dated Sep. 25, 2014.
International Search Report and Written Opinion from Appl. No. PCT/CN2013/072772, dated Dec. 19, 2013.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Office Action from U.S. Appl. No. 13/899,314, dated Jan. 15, 2015.
Office Action from U.S. Appl. No. 13/842,150, dated Jan. 22, 2015.
Office Action from U.S. Appl. No. 13/829,558, dated Mar. 9, 2015.
Office Action from U.S. Appl. No. 13/958,462, dated Mar. 10, 2015.
Office Action from U.S. Appl. No. 13/829,558, dated Sep. 30, 2014.
Office Action from U.S. Appl. No. 29/450,283, dated Nov. 5, 2014.
Office Action from U.S. Appl. No. 29/449,316, dated Nov. 26, 2014.
Office Action from U.S. Appl. No. 13/840,812, dated Nov. 28, 2014.
Office Action from U.S. Appl. No. 13/763,270, dated Oct. 3, 2014.
Office Action from U.S. Appl. No. 13/834,605, dated Apr. 9, 2015.
Office Action from U.S. Appl. No. 13/840,812, dated May 12, 2015.
Office Action from U.S. Appl. No. 13/910,486, dated May 7, 2015.
Office Action from U.S. Appl. No. 13/763,270, dated May 19, 2015.
Office Action from U.S. Appl. No. 13/899,314, dated Jul. 29, 2015.
Response to OA from U.S. Appl. No. 13/899,314, filed Sep. 15, 2015.
Office Action from U.S. Appl. No. 13/842,150, dated Aug. 10, 2015.
Office Action from U.S. Appl. No. 13/829,558, dated Sep. 11, 2015.
Office Action from U.S. Appl. No. 14/108,168; Dec. 24, 2015.
Office Action from U.S. Appl. No. 13/842,150; Dec. 30, 2015.
Office Action from U.S. Appl. No. 13/763,270; Jan. 12, 2016.
Office Action from U.S. Appl. No. 13/899,314; Feb. 4, 2016.
Office Action from U.S. Appl. No. 14/070,098; Feb. 5, 2016.
Office Action from U.S. Appl. No. 13/829,558; Feb. 19, 2016.

(56) References Cited

OTHER PUBLICATIONS

Office Action from U.S. Appl. No. 13/910,486; Mar. 1, 2016.
Office Action from U.S. Appl. No. 14/108,168; May 20, 2016.
Office Action from U.S. Appl. No. 14/252,685; May 20, 2016.
Office Action from U.S. Appl. No. 14/252,685, dated Oct. 1, 2015.
Office Action from U.S. Appl. No. 13/958,461, dated Oct. 15, 2015.
Office Action from U.S. Appl. No. 13/910,486, dated Oct. 15, 2015.
Response to OA from U.S. Appl. No. 13/910,486, filed Dec. 15, 2015.
Office Action from U.S. Appl. No. 13/782,820, dated Oct. 30, 2015.
Office Action from U.S. Appl. No. 13/899,314, dated Nov. 13, 2015.
Response to OA from U.S. Appl. No. 13/899,314, filed Dec. 16, 2015.
Office Action from U.S. Appl. No. 14/020,750, dated Dec. 14, 2015.
Office Action for U.S. Appl. No. 13/958,461; Jun. 17, 2016.
Office Action for U.S. Appl. No. 13/910,486; Jun. 23, 2016.
Office Action for U.S. Appl. No. 13/763,270; Jul. 15, 2016.

* cited by examiner

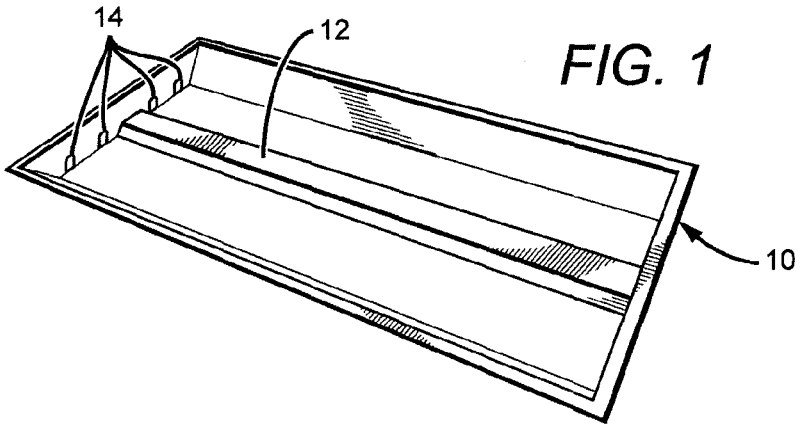
FIG. 1
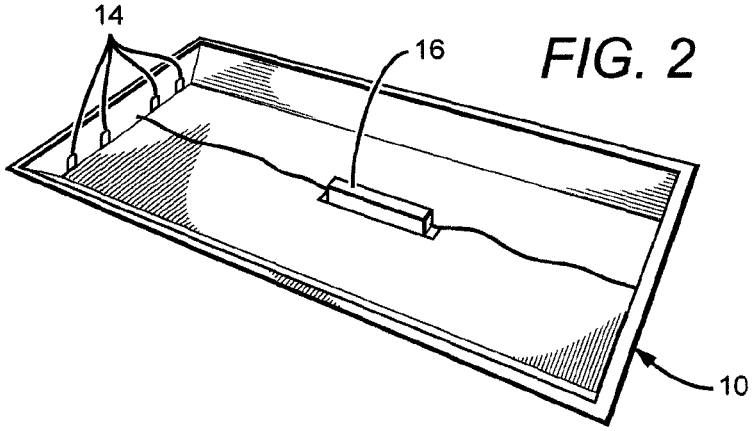
FIG. 2
FIG. 3
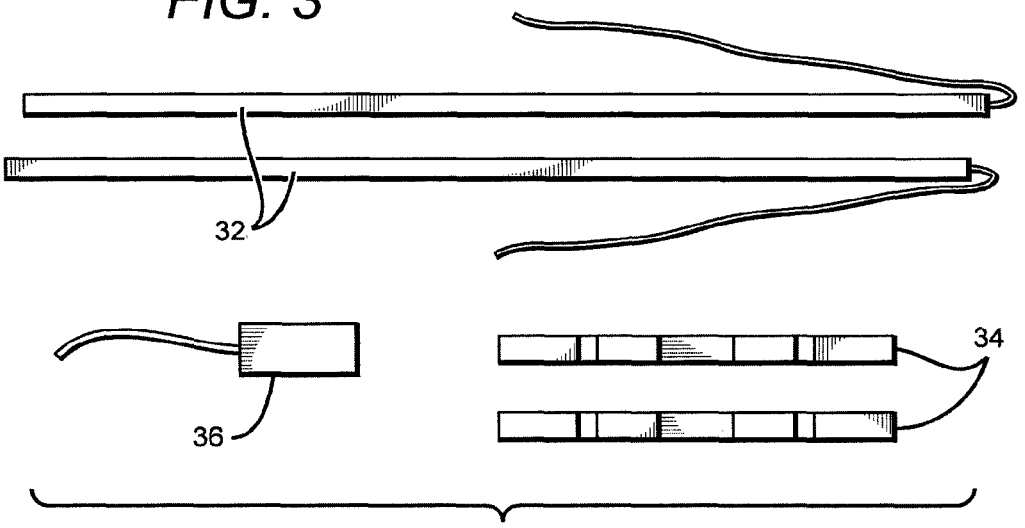

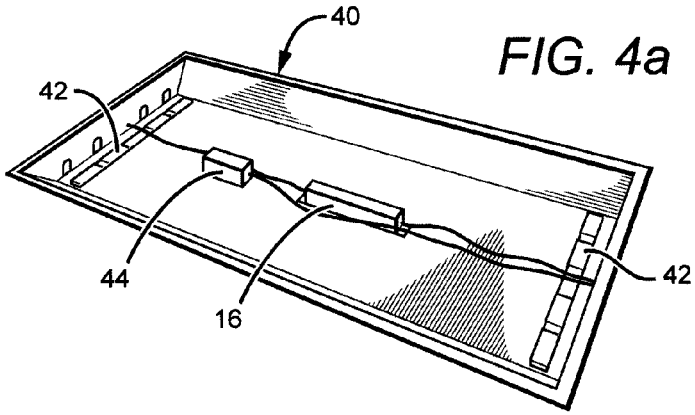
FIG. 4a
FIG. 4b
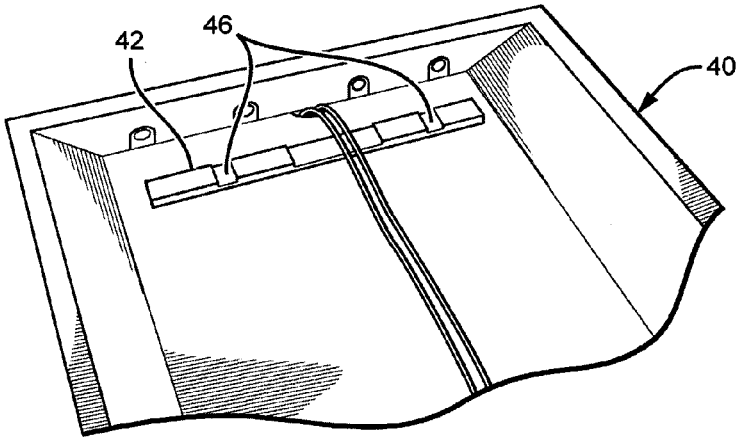
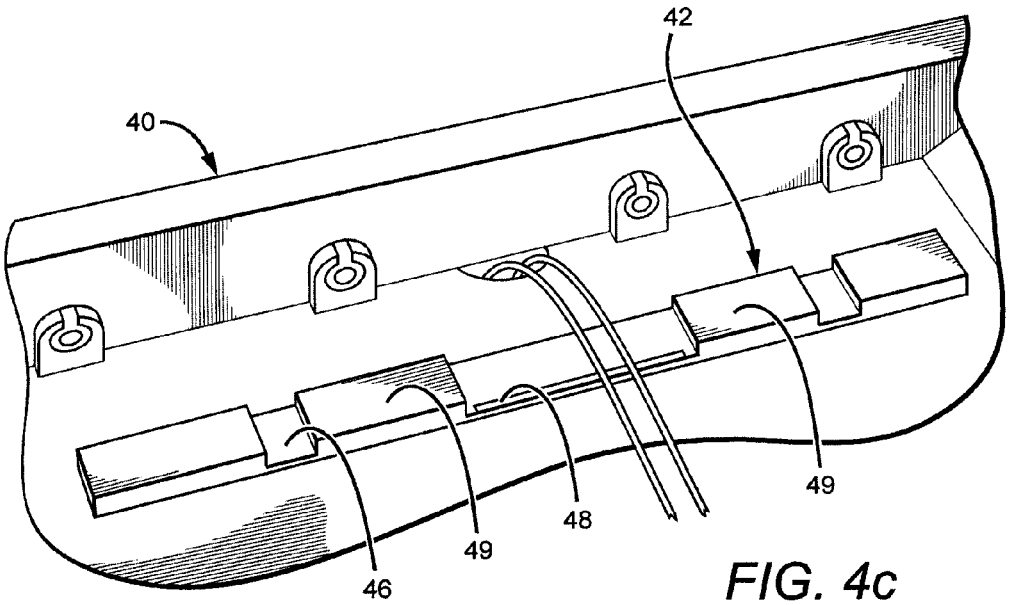
FIG. 4c

RECESSED LIGHT FIXTURE RETROFIT KIT

BACKGROUND OF THE INVENTION

Field of the Invention

The invention relates to retrofit systems and methods for lighting installations, and in particular, to retrofit systems and methods used to retrofit troffer-style lighting installations with LED light sources.

Description of the Related Art

Troffer-style fixtures are ubiquitous in commercial office and industrial spaces throughout the world. In many instances these troffers house elongated tubular fluorescent lamps or light bulbs that span the length of the troffer. Troffers may be mounted to or suspended from ceilings, such as being, suspended by a "T-grid". Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs as their light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

There has been recent interest in upgrading existing troffer style lighting systems with LED sources (or engines) to capitalize on the above advantages. Current options for upgrading include complete fixture replacement such as by the commercially available CR Series Architectural LED Troffer, provided by Cree, Inc. Some features of these troffers are described in U.S. patent application Ser. No. 12/873,303, titled "Troffer-style Fixture", and assigned to Cree, Inc. Performing complete fixture replacement can require penetrating the ceiling plenum by a skilled technician. This can be time consuming and expensive, and in many locations, building codes can require that a licensed electrician perform any work in the plenum space above a ceiling.

SUMMARY OF THE INVENTION

Some embodiments of the present invention comprise a mechanical mounting system for installing an LED light engine or light source within an existing lighting system housing or pan, such as a troffer pan, without penetrating the ceiling plenum. One configuration comprises a system for mounting a light engine in a fixture. This system comprises a plurality of mounting brackets configured to be mounted within an existing light fixture. The mounting brackets are held in place by the geometry or features of the existing light fixture. The system also includes light source bars configured to engage each of the mounting brackets.

Another configuration describes a system for retrofitting existing lighting troffer pans. This system comprises a plurality of mounting brackets configured to be mounted within the troffer pan. The mounting brackets are held in place by a raceway cover of the troffer pan. The system also includes light source bars having a mechanism allowing the light source bars to engage with the mounting brackets.

Yet another configuration sets out a method for retrofitting a light engine in a fixture. This method comprises providing a fixture with a plurality of mounting brackets. The method further includes securing the mounting bracket to the fixture with components of the fixture, and engaging at least one light source bar with the mounting bracket.

These and other further features and advantages of the invention would be apparent to those skilled in the art from the following detailed description, taken together with the accompanying drawings, in which:

BRIEF DESCRIPTION OF THE DRAWINGS

FIG. 1 is a perspective view of an exemplary lighting fixture to be retrofitted according to the present disclosure.

FIG. 2 is a perspective view of a lighting fixture with the raceway cover removed according to the present disclosure.

FIG. 3 is a top view of retrofit components according to the present disclosure.

FIG. 4*a* is a perspective view of the fixture of FIG. 2 with the mounting brackets in place according to the present disclosure.

FIG. 4*b* is a closer view of a portion of FIG. 4*a* with the power supplies removed for ease of viewability according to the present disclosure.

FIG. 4*c* is a closer view of a portion of FIG. 4*a* according to the present disclosure.

DETAILED DESCRIPTION OF THE INVENTION

Figure 5:
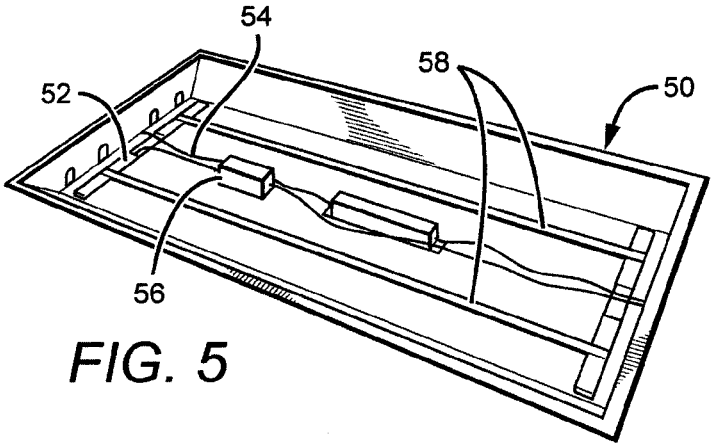
FIG. 5 is a perspective view of a light fixture during the retrofit process with light source bars engaged according to the present disclosure.

Embodiments of the present invention provide retrofit systems that can be used with different light fixtures, but that are particularly adapted for use with troffer-style fixtures. These retrofit systems can provide the same amount of light as traditional light fixtures already do, for example 1600-4000 lumens and above. The retrofit systems can be used with many different light sources but are particularly well-suited for use with solid state light sources or light engines, such as those utilizing LEDs. Some embodiments of the present invention comprise a mechanical mounting system for installing an LED light engine within an existing lighting system housing or pan, such as a troffer pan, without penetrating the ceiling plenum.

By leaving the existing troffer pan in place, embodiments of the present invention can rely on the troffer pan to act as a barrier against the spread of fire and smoke. In many areas, local codes may not allow for the use of plastic components inside the plenum space above the ceiling. This is due to concerns that if a fire occurred in one room, toxic smoke from burning plastics could be carried to other locations which share the air plenum. Maintaining the host fixture's troffer pan as a barrier to this spread of toxic smoke can allow for the use of lower cost plastic parts above the ceiling line in the troffer pan. Without the troffer pan barrier, these plastic parts might otherwise not be allowed in the plenum space.

During the upgrade process, contamination may also be a concern, particularly in a hospital or clean room environment. In upgrade processes where the entire fixture is replaced, the sheet metal pan or housing of an existing troffer lighting system is removed. Removing the "host fixture" pan can generate dust which must be contained, and the surrounding area must be cleaned prior to resuming normal operations within the environment. Preventing dust is of particular concern in the case of dust containing dangerous materials such as asbestos. In certain environments, construction permits may be required for an upgrade process that requires removal of the troffer pan, which can add additional complications and costs.

Another alternative upgrade option is by a fixture retrofit where a new LED based light engine or light source can be installed into the sheet metal pan of an existing troffer lighting system. This can provide the advantage of using light engines with design features such as reflectors, lenses, and power supplies which have been optimized for an LED-based system. It also allows light engines which are approved for use in other applications to be used in a retrofit application. Some retrofits can provide the advantage of not removing the existing troffer pan, with the pan acting as a barrier to the above-ceiling plenum space. Leaving the pan intact during the retrofit process does not disturb wiring connections, insulation, etc., found in the plenum space. Leaving the pan in place may also allow for work to be performed by non-licensed personal, which can result in a significant cost savings over work performed by licensed electricians.

Many upgrades involve replacing the fluorescent light bulbs/tubes with replacement tubes having LEDs along their length. This upgrade can fit existing fluorescent lamp fixtures and can rely on the fixture's electrical ballast and wiring. However, compared to light engines designed to capitalize on the characteristics of LEDs, these replacement lamps may utilize much more energy for a given light output (lower efficacy), and can provide little or no cost benefit. Furthermore, these upgrades require costly interface connectors to connect to the existing tombstone connections. In addition, the retrofitter is forced to rely upon the mechanical and electrical reliability of the original manufacturer and fixture. An aged fixture may have significantly weakened tombstones.

The present invention is described herein with reference to certain embodiments, but it is understood that the invention can be embodied in many different forms and should not be construed as limited to the embodiments set forth herein. In particular, the present invention is described below in regards to certain retrofit systems that can be used to retrofit and/or upgrade troffer-style fixtures or lighting systems, but it is understood that the system can be used to retrofit and/or upgrade different types of lighting systems. The retrofit systems can also be used with many different light systems, sources and engines beyond those described herein, with many being LED based.

It is understood that when an element can be referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

As mentioned above, embodiments of the present invention can comprise a mechanical mounting system for installing an LED light engine or light source within an existing lighting system pan, such as the opening of a troffer pan, without penetrating the ceiling plenum. The light engine can be provided with a mounting feature or mount bracket that quickly and easily engages the troffer pan. Different mount adaptors can be arranged in different ways, with some being provided as a single piece adaptor, and others being provided as a multiple piece adaptor. Additionally, the mounting bracket may be provided with guides or other devices that allow for consistent and error free placement of the mounting bracket during the retrofit process.

In some configurations, the mount bracket may be a multi-function piece of equipment, which serves to correctly orient and space the light sources, hold the light sources in place, and provide a wiring path from the light sources to the power supply, both hiding the wiring and providing desired spacing or enclosures for electrical ratings, such as high voltage regulatory requirements. Initial installation of the mounting bracket may incorporate the use a temporary holding mechanism to hold the bracket in place until further along in the process when the mounting bracket is secured in place.

In one exemplary retrofit system, the ballast or raceway of the original system is temporarily removed to begin the retrofit. Once the raceway or ballast is removed, mounting brackets may be placed within the troffer pan. The brackets may be shaped or sized to only fit in the proper installation location, or other types of markers or guides can be used to insure that the brackets are always consistently and correctly placed. Once the mounting bracket is placed in the correct location, and possibly temporarily fastened in place, light sources and wiring can be manipulated in place on the bracket.

If required, a new power supply may be placed in place of or adjacent to the existing power supply, under the raceway or ballast area. In some configurations, the power supply may be designed to interface with existing fixture fastening features for ease of installation, such as holes, flanges, and cutouts. The power supply is responsible for delivering the electrical voltage and current to the light source bars. The power supply receives line voltage from the fixture input (bypassing the existing ballast), for example 120 VAC. Wiring for this power supply may then be passed through a wire routing path in the mounting bracket between the light source and the power supply. This wire routing path may include a separate cover which can be put in place over the wires or a portion of the bracket itself may be used to cover the path, such as a living hinge cover of the wire path.

The mounting bracket may include features to receive and fasten light sources. Light sources may be fastened into place on the bracket using a variety of suitable methods, such as but not limited to snap fit, screws, adhesive, twist, interference fit, or press fit. Mounting brackets may be placed at each end of the troffer pan, additional mounting brackets may be included, or any other configuration of mounting brackets may be used.

The light sources or light source bars may be any appropriate light source which can be retrofitted in place of a fluorescent light bar. The light source in some configurations may be a plurality of LEDs or other solid state light chips spaced across a circuit board, such as a PCB which may be rigid or flexible. This circuit board with LEDs may be placed within a cover or other holding device. The LEDs may be in series or parallel or a combination of both. Also, the light source may include power supply components or circuitry, or this circuitry may be located separate from the light sources. The light sources may also include a heat sink; however, in configurations where high efficiency LEDs are used, a heat sink may not be necessary as the traces on the PCB may be enough to dissipate heat. Previously, light sources or light bars did not use heat sinks which resulted in light source failure. As heat sink and light source technology has matured, heat sinks now are used and required in all applications. Though, traditionally, heat sinks are required for adequate heat dissipation, it is possible in configurations of the light bars to exclude a heat sink and provide sufficient heat dissipation by only using the traces on the circuit board. Inclusion of a heat sink involves the added cost and manufacturing allowances for a heat sink. The light bars of the current disclosure, which do not require a heat sink, allow the light bars to be more efficient in terms of cost and manufacturing.

In some configurations, the light source includes a housing. This housing may include a cover over the LEDs. This cover may be translucent and in some configurations include a diffuser to provide a more uniform appearance of the light source. The housing includes a mechanism to hold the PCB in place, such as a snap fit, adhesive, a slide in channel, heat sink, vibration weld, sonic weld, or any other suitable mechanism. The housing may also include features to secure the light source bar to the mounting bracket. The housing provides a rigid form for the light source. Each light source bar may be one rigid piece or multiple rigid sections. Additionally, one light source bar may span an entire troffer pan or multiple portions may be strung together. The housing portion may include optional end caps for closing off or sealing each light source.

Each light source bar is connected to a power supply, directly or via another light source bar. This power supply is responsible for delivering electrical voltage and current to the light source and receives line voltage from the light fixture input. Though each light source may include power supply components, in some configurations, the power supply is separate from the light sources and fits inside the existing fixtures ballast or raceway cover. In some embodiments, the power supply may be designed to interface with the existing fixture fastening features for power supplies, such as holes, flanges and cutouts. In other configurations, the power supply can be fastened with other attachment methods. This power supply may replace the original power supply or simply be installed adjacent to it.

FIGS. 1 and 2 show an existing light fixture with the legacy light engine removed, for example fluorescent light bulbs. The existing light fixture includes a troffer pan 10 and a ballast or raceway cover 12. The legacy tombstone connections 14 can be seen at the top and bottom of the troffer pan 10. The first step in retrofitting the troffer pan 10 with the new light engine or light source begins with removing the raceway cover 12, as shown in FIG. 2. The legacy power supply components 16 and associated wiring can be found under the raceway cover 12. Following this step, the components of the retrofit light engine can be installed.

FIG. 3 shows exemplary components of a retrofit light engine of one configuration, such as light source bars 32, mounting brackets 34, and a power supply 36. A new power supply 36, which is more suitable for the retrofit system may be installed in place or in addition to the existing power supply 16, shown in FIG. 2. In other configurations, the existing power supply 16 may be used for the retrofit system as well. In yet other configurations, the power supply components may be placed in the light source bars themselves. In another configuration, additional power supplies may be used for 2 or more light bars.

FIGS. 4*a*-4*c* show the next step of the retrofit process which entails the installation of the mounting brackets 42 in the troffer pan 40. This configuration shows both the new power supply 44 and legacy power supply 46 in place within the troffer pan 40. The mounting brackets 42 may be made of any suitable material including plastics or metals. These may be manufactured using an extrusion and post processing method or any other suitable method. Although only two mounting brackets 42 are shown in the figures, any number of them may be used in any location. Generally, at least two mounting brackets 42 will be used, with the first two being located proximate to the edges or ends of the troffer pan 40. The mounting brackets 42 are multi-functional brackets as they serve to fix the light source bars in place, insure that the light source bars are oriented correctly, and also provide a wiring path for connecting the light source bars to power.

Considering that most retrofittings would occur while a light fixture is already installed in a ceiling, it is beneficial to provide features which make the retrofit process easier and as close to error free as possible, while working with a fixture that is overhead and cannot be manipulated. Therefore, in some configurations, the mounting brackets 42 will include guides or guiding features (not shown) to allow for consistent and error free mounting within the troffer pan 40. Such guides or guide features may include shaping which prevents the mounting brackets from being mounted in a location other than the correct location. In another embodiment, the guide features may include extensions such as markers which can come in contact with the edges of the troffer pan and provide accurate orientation of the mounting brackets in relation to the troffer pan. In yet another embodiment, an installer may use marks or features of the troffer pan itself to correctly orient and mount the mounting brackets.

Some configurations may include a temporary fastener to the troffer pan 40 to facilitate installation of the mounting brackets 42. A temporary fastener may be a pressure sensitive fastener, such as an adhesive, or any other suitable temporary fastening mechanism such as screws, press fit, snap fit, twist, or interference fit. This would allow the installer to place the mounting bracket in the correct location and continue with the retrofit process without having to hold the mounting bracket in place until the mounting bracket can be fully secured.

FIGS. 4*b* and 4*c* show closer images of the mounting bracket 42 in place but not finally secured. As shown, the mounting bracket 42 extends across the troffer pan 40, such that a portion of the mounting bracket 42 would be under the raceway cover when the raceway cover is reinstalled. In this configuration, the raceway cover would hold and secure the mounting bracket 42 in place (and relieve the temporary fastening mechanism of reliable mounting). The mounting bracket includes a ballast or raceway cover stand-off portion 48, to space the raceway cover from the mounting bracket slightly, allowing wires to pass under the raceway cover to the wire path 49 without being pinched or chaffed. In other configurations other suitable methods may be used to prevent pinching of the wires, such as indentations in the mounting bracket.

Moving outward from the center of the mounting bracket 42, past the wire path 49 is the light source bar mounting or engaging portion 46. This area 46 is where light source bars engage or mount to the mounting bracket 42. The mounting bracket 42 includes features to interface with the light source bar. In some configurations, the light source bars snap into place in the engaging portion 46. However, in other configurations, the light source bar may be fastened using other mechanisms, such as press fit, screws, twist fit, adhesives, interference fit, or any other suitable fastening mechanism. In retrofits which have multiple light source bars, the mounting bracket may have predefined interface locations so the installer can position them correctly.

Figure 6:
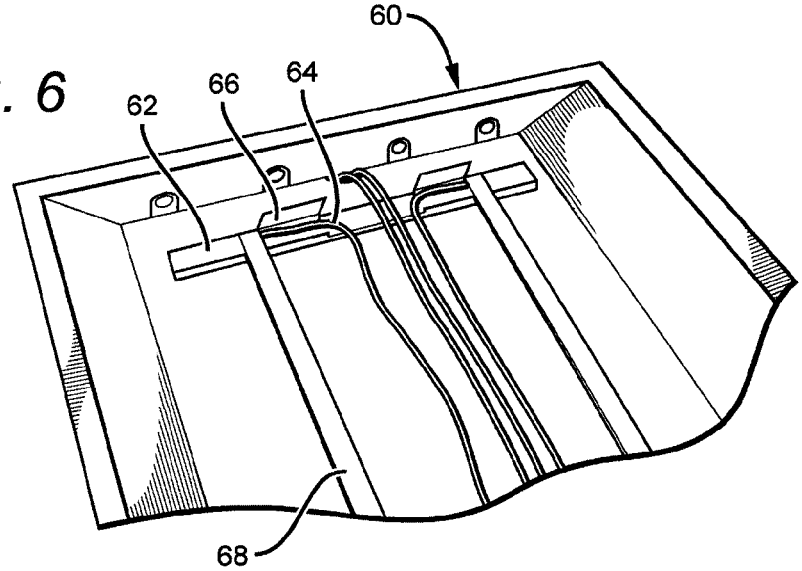
FIG. 6 is a closer view of a portion of FIG. 5 according to the present disclosure.

As can be seen in the troffer pans 50, 60 shown in FIGS. 5 and 6, the wires 54, 64 from a power supply 56 are passed through a wire path 66 of mounting brackets 52, 62 to light source bars 58, 68. The wire path 66 provides an enclosure to both protect and hide the wiring, although neither may be necessary. Wire protection may prevent the wires from being cut, damaged, or otherwise harmed, as they may be when exposed. The wire path includes a way to provide access to pass the wires. Access to the wire path 66 may be provided by a hinged or removable portion. In FIG. 4*c* the wire path is shown with the hinged or removable portion in place and therefore the wire path 49 is enclosed. The FIG. 6 the wire path 66 is shown open with a hinged portion. This hinged portion may be constructed using a living hinge. A living hinge is preferable as it mitigates the need for a separate cover. Other embodiments may use a removable portion which could be a secondary snap cover or a cam in place cover.

Figure 7:
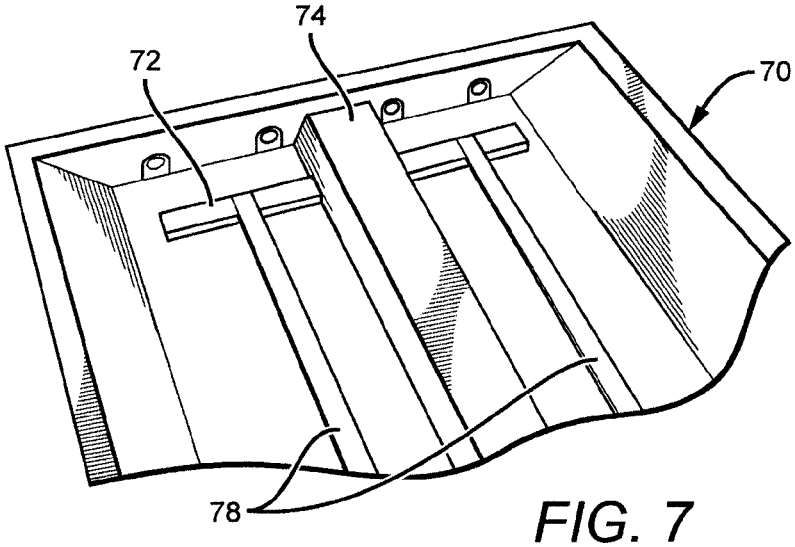
FIG. 7 is a perspective partial view of a retrofitted fixture after the raceway cover has been replaced according to the present disclosure.
Figure 8:
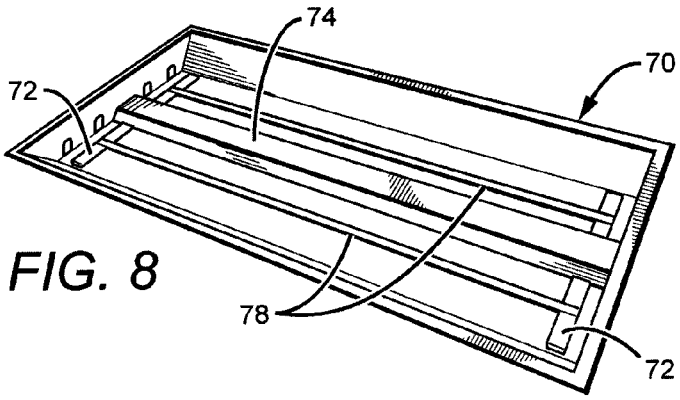
FIG. 8 is a perspective full view of the fixture of FIG. 7 according to the present disclosure.

Next, referring to FIGS. 7 and 8, after the mounting brackets 72, optional power supply, light source bars 78 and wiring are in place, the ballast or raceway cover 74 may be reinstalled in its original position in the troffer pan 70, now over and securing the mounting brackets 72. The retrofit is complete at this stage.

Figure 9:
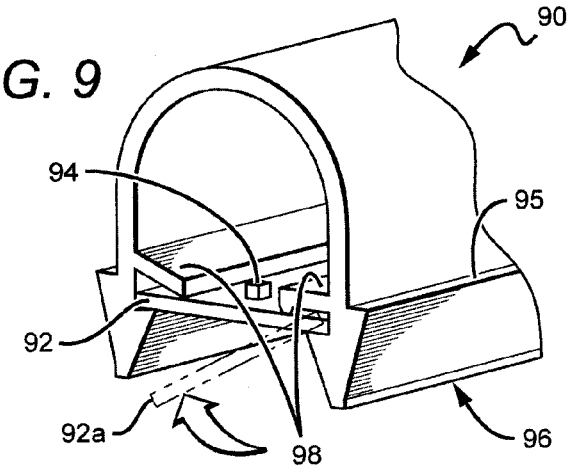
FIG. 9 is a side cross section perspective view of an exemplary light source bar according to the present disclosure.
Figure 10A:
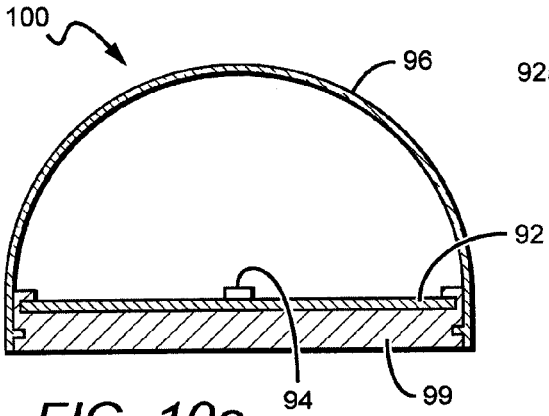
FIG. 10*a* is a side cross section view of another light source bar according to the present disclosure.
Figure 10B:
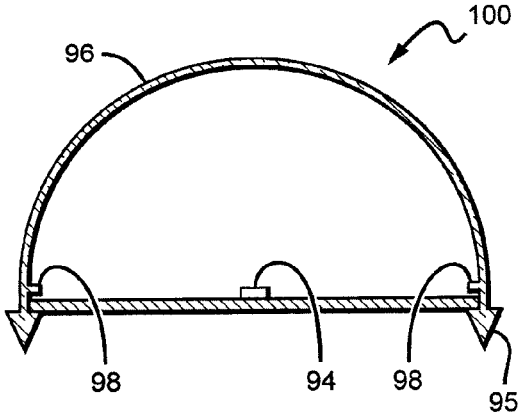
FIG. 10*b* is a side cross section view of another light source bar according to the present disclosure.

The light source bars may be configured and constructed in a variety of manners. FIGS. 9-10*b* show some configurations of light source bars and light source bar housings. Light source bar 90, 100 may include several components such as a housing 96, circuit board 92, and light source chips or LEDs 94. Generally, the LEDs are spaced uniformly across the circuit board to provide uniform lighting; however, they may be placed or spaced in any way preferred for a particular lighting application. The housing 96 may include several portions as well, such as a translucent or diffuse top portion, which functions to both protect the LEDs and as a lens. A lens is not required and can be omitted in some configurations. The housing can be a single extrusion or can include multiple portions. It is only required that the areas through which light will be omitted be clear or diffuse; however, to simplify manufacturing the entire housing may be clear or diffuse.

The housing may also include holding features 98 to keep the circuit board 92 in place. The holding feature 98 may be advantageous in some configurations because it can also function to hold in place reflective layers or coatings on the circuit board which may come loose when the adhesive used to apply the layer fails. Holding features 98 may also be coextruded in a reflective white material to replace an often used reflective film. Some light source bars, such as the one shown in FIG. 10*a*, may also include a heat sink 99. However, as discussed previously it is possible, and may be advantageous, to omit the heat sink 99 in some configurations, using alternate methods to dissipate heat, such as the traces on the circuit board.

The circuit board 92 may be any suitable circuit board including those that are rigid or flexible. In the configuration shown in FIGS. 9 and 10*b*, the circuit board 92 is pivoted into place, or one may cam in the circuit board 92*a* and then snap it in place. The housing 96 should be at least in part rigid to support the circuit board and to aid in mounting and holding in place the light source bar 90. The entire light source bar 90 may be a single rigid portion, or it may comprise of multiple rigid portions.

The light source bar 90, 100, or housing portion 96 of the light source bar 90, includes features to engage it with the mounting bracket. These features may include screws, adhesives, twist fit, press fit, interference fit or snap fit features. In the configuration shown in FIGS. 9 and 10*b*, features to provide a snap fit 95 are shown. However, it will be understood that any appropriate engaging feature may be used. These engagement features may run across the entire length of the light source bar 90 or may only exist in designated portions, which are known to possibly engage with a mounting bracket, such as the ends and in some cases intervening sections. Though not shown, the light source bar 90 may also include an end cap which includes features 95 to engage the light source bar. In some cases, multiple light source bars may be strung together across one troffer pan.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

I claim:

1. A system for mounting a light source in a fixture, comprising:

at least two mounting brackets configured to be mounted within an existing light fixture, in which the mounting bracket further comprises a wire path for at least a wire providing power to the light source bar, in which the wire path comprises a covered portion enclosing at least a portion of the wire path, wherein said wire path runs orthogonal to said light source bar; and light source bars configured to engage each of the mounting brackets.

2. The system of claim 1, wherein the light source bars engage the mounting brackets by a mechanism comprising snap fit, press fit, interference fit, adhesive, screw or twist.

3. The system of claim 1, in which the mounting brackets are held in place by a feature of the existing light fixture.

4. The system of claim 3, in which the feature is a raceway cover.

5. The system of claim 1, in which the mounting bracket includes a temporary fastener.

6. The system of claim 1, further comprising a power supply connected to the light source bars.

7. The system of claim 6, in which the mounting bracket comprises a living hinge portion.

8. The system of claim 6, in which the mounting bracket comprises a removable cover.

9. The system of claim 1, in which the mounting brackets further comprise guides for consistent mounting.

10. The system of claim 1, in which the plurality of mounting brackets are configured to be mounted within a troffer pan.

11. The system of claim 1, in which at least one of the mounting brackets is mounted proximate to an edge of the fixture.

12. The system of claim 1, in which the light source bar comprises a housing, a circuit board and a plurality of LEDs on the circuit board.

13. The system of claim 12, in which the light source bar is rigid.

14. The system of claim 12, in which the light source bar comprises multiple rigid portions.

15. The system of claim 12, in which the light source bar is capable of dissipating heat without the use of a heat sink.

16. The system of claim 12, in which the light source bar is capable of dissipating heat using traces on the circuit board.

17. The system of claim 12, in which the circuit board is held in place by at least a portion of the housing.

18. The system of claim 12, in which the housing comprises features which allow it to snap fit with the mounting brackets.

19. A system for mounting a light source in a fixture, comprising:

at least two mounting brackets configured to be mounted within an existing light fixture; and light source bars, each of which is positioned between and configured to engage at least two of said mounting brackets, said light source bars comprising a housing, a circuit board and a plurality of LEDs on the circuit board, in which the circuit board is held in place by a snap fit connection.

20. A system for mounting a light source in a fixture, comprising:

at least two mounting brackets configured to be mounted within an existing light fixture; and light source bars, each of which is positioned between and configured to engage at least two of said mounting brackets, said light source bars comprising a housing, a circuit board and a plurality of LEDs on the circuit board, in which the housing further comprises a lens portion.

21. A system for retrofitting existing lighting troffer pans, comprising:

a plurality of mounting brackets configured to be mounted within the troffer pan, in which said mounting brackets are configured to be held in place by a raceway cover of the troffer pan; and light source bars comprising a mechanism that allows the light source bars to engage with the mounting brackets, such that said light source bars are positioned against a bottom surface of said mounting bracket.

22. The system of claim 21, in which the mechanism includes at least one of a snap fit, press fit, interference fit, adhesive, screw or twist.

23. The system of claim 21, in which the mounting bracket comprises a wire path for at least a wire providing power to the light source bar.

24. The system of claim 23, in which the wire path comprises a covered portion enclosing at least a portion of the wire path.

25. The system of claim 21, in which the mounting brackets are held in place by an interference fit with the raceway cover of the troffer pan.

26. The system of claim 21, in which the mounting bracket includes a temporary fastener.

27. The system of claim 21, further comprising a power supply connected to the light source bars.

28. The system of claim 27, in which the mounting bracket comprises a living hinged portion.

29. The system of claim 27, in which the mounting bracket comprises a removable cover.

30. The system of claim 21, in which the mounting brackets comprise guides for consistent mounting.

31. The system of claim 21, in which at least one of the mounting brackets is mounted proximate to an edge of the troffer pan.

32. The system of claim 21, in which the light source bar is comprised of a housing, a circuit board and a plurality of LEDs on the circuit board.

33. The system of claim 32, in which the light source bar is rigid.

34. The system of claim 32, in which the light source bar comprises multiple rigid portions.

35. The system of claim 32, in which the LEDs are spaced equidistantly across the circuit board.

36. The system of claim 32, in which the light source bar is capable of dissipating heat generated by the LEDS without the use of a heat sink.

37. The system of claim 32, in which the light source bar is capable of dissipating heat generated by the LEDs using traces on the circuit board.

38. The system of claim 32, in which the circuit board is held in place by at least a portion of the housing.

39. The system of claim 38, in which the circuit board is held in place by a snap fit.

40. The system of claim 32, in which the housing comprises a lens portion.

41. The system of claim 32, in which the housing comprises features which allow it to snap fit with the mounting brackets.

42. The system of claim 21, in which the mounting brackets are mounted within the troffer pan by a mechanism including at least one of a snap fit, press fit, interference fit, adhesive, screw or twist.

43. A system for retrofitting existing lighting troffer pans, comprising:

a plurality of mounting brackets configured to be mounted within the troffer pan; and light source bars comprising a mechanism that allows the light source bars to engage with the mounting brackets said mounting bracket comprising a temporary fastener, in which the temporary fastener is an adhesive, in which the light source bar is comprised of a housing, a circuit board and a plurality of LEDs disposed on the circuit board.

44. A method for retrofitting a light source in an existing fixture, comprising:

providing a plurality of mounting brackets configured to be mounted in a fixture;

securing the mounting brackets to the existing fixture, in which the mounting brackets are configured to be secured by a raceway cover of the fixture; and engaging at least one light source bar with the mounting bracket.

45. The method of claim 44, further comprising passing power wires through a wire path of at least one of said mounting brackets.

46. The method of claim 44, further comprising connecting the light source bar to a power source via said power wires.

47. The method of claim 44, further comprising providing a power supply.

48. The method of claim 44, in which the mounting brackets are configured to be secured to a troffer pan of a fixture.

49. The method of claim 44, in which engaging comprises engaging with at least one of a snap fit, press fit, interference fit, adhesive, screw or twist.

50. The method of claim 44, in which securing the mounting bracket comprises using an interference fit with a raceway cover of the fixture.

51. The method of claim 44, further comprising temporarily attaching the mounting bracket with a temporary fastener.

52. The method of claim 51, in which the temporary fastener is an adhesive.

53. The method of claim 45, further comprising enclosing a portion of the wire path.

54. The method of claim 53, in which enclosing comprises using a living hinged portion of the mounting bracket.

55. The method of claim 53, in which enclosing comprises using a removable cover.

56. The method of claim 44, in which the mounting brackets comprise guides for consistent mounting.

57. The method of claim 44, in which at least one of the mounting brackets is mounted proximate to an edge of the fixture.

58. The method of claim 44, in which the light source bar comprises a housing, a circuit board and a plurality of LEDs on the circuit board.

59. The method of claim 44, in which the light source bar is rigid.

60. The method of claim 44, in which the light source bar comprises multiple rigid portions.

61. The method of claim 58, in which the LEDs are spaced equidistantly across the circuit board.

62. The method of claim 58, further comprising dissipating heat from the plurality of LEDs without the use of a heat sink.

63. The method of claim 58, further comprising dissipating heat from the plurality of LEDs using traces on the circuit board.

64. The method of claim 58, in which the circuit board is held in place by at least a portion of the housing.

65. The method of claim 64, in which the circuit board is held in place by a snap fit.

66. The method of claim 58, in which the housing comprises a lens portion.

67. The method of claim 58, in which the housing comprises features which allow it to snap fit with the mounting brackets.

68. The method of claim 44, in which securing comprises using at least one of a snap fit, press fit, interference fit, adhesive, screw or twist.

* * * * *